US011254993B2

(12) United States Patent
Itofuji et al.

(10) Patent No.: US 11,254,993 B2
(45) **Date of Patent: *Feb. 22, 2022**

(54) METHOD FOR PRODUCING DIE-CAST PRODUCT OF SPHEROIDAL GRAPHITE CAST IRON HAVING ULTRAFINE SPHEROIDAL GRAPHITE, AND DIE-CAST PRODUCT OF SPHEROIDAL GRAPHITE CAST IRON

(71) Applicants: I2C CO., LTD., Yamaguchi (JP); Tohoku University, Miyagi (JP)

(72) Inventors: Haruki Itofuji, Yamaguchi (JP); Masayuki Itamura, Miyagi (JP); Koichi Anzai, Miyagi (JP); Kazuyoshi Yamaguchi, Miyagi (JP)

(73) Assignees: I2C CO., LTD., Yamaguchi (JP); TOHOKU UNIVERSITY, Miyagi (JP)

( * ) Notice: Subject to any disclaimer, the term of this patent is extended or adjusted under 35 U.S.C. 154(b) by 483 days.

This patent is subject to a terminal disclaimer.

(21) Appl. No.: 15/744,454

(22) PCT Filed: Jul. 15, 2016

(86) PCT No.: PCT/JP2016/071036

§ 371 (c)(1),
(2) Date: Jan. 12, 2018

(87) PCT Pub. No.: WO2017/010569

PCT Pub. Date: Jan. 19, 2017

(65) Prior Publication Data

US 2018/0371561 A1 Dec. 27, 2018

(30) Foreign Application Priority Data

Jul. 15, 2015 (JP) ..... JP2015-141385

(51) Int. Cl.

| | |
|---|---|
| ***C21C 1/10*** | (2006.01) |
| ***B22D 27/20*** | (2006.01) |
| ***C22C 38/04*** | (2006.01) |
| ***C22C 38/02*** | (2006.01) |
| ***C22C 38/00*** | (2006.01) |

(52) U.S. Cl.
CPC ..... *C21C 1/10* (2013.01); *B22D 27/20* (2013.01); *C22C 38/002* (2013.01); *C22C 38/02* (2013.01); *C22C 38/04* (2013.01)

(58) Field of Classification Search
CPC ..... B22D 27/20; C21C 1/10; C22C 38/002; C22C 38/02; C22C 38/04
See application file for complete search history.

(56) References Cited

FOREIGN PATENT DOCUMENTS

| | | | | |
|---|---|---|---|---|
| JP | 63-260667 | | 10/1988 | |
| JP | 01-309939 | | 12/1989 | |
| JP | 06-93369 | | 4/1994 | |
| JP | 2000-045011 | | 2/2000 | |
| JP | 2003-286538 | | 10/2003 | |
| JP | 2004-223608 | | 8/2004 | |
| JP | 2004223608 | A * | 8/2004 | ..... B22C 9/061 |
| JP | 2006-063396 | | 3/2006 | |
| JP | 2006063396 | A * | 3/2006 | |

OTHER PUBLICATIONS

Cold hard die casting of ductile iron By Itofuji, Haruki (Year: 2015).*
Chill reducing method of As-cast spheroidal graphite cast iron using metal mold By Yongha Lee (Year: 1983).*
International Search Report, PCT/JP2016/071036, dated Sep. 27, 2016.

* cited by examiner

*Primary Examiner* — Jenny R Wu
(74) *Attorney, Agent, or Firm* — Nixon & Vanderhye

(57) ABSTRACT

For the purpose of providing a method of die cast product of spheroidal graphite cast iron and a die cast product of spheroidal graphite cast iron having the number of spherical graphites of 3000/mm$^2$ or more in an as cast state, there is disclosed a method of die cast product of ultrafine spheroidal graphite cast iron, including the steps of: a melting step of heating and melting raw materials made of cast iron to obtain source melting metal; a spheroidizing treatment step in which a spheroidizing treatment is performed; an inoculation step of inoculating; and a casting step of casting in a die mold. The amount of nitrogen is adjusted so that the amount of nitrogen generated in the time of melting becomes 0.9 ppm (mass) or less.

10 Claims, 5 Drawing Sheets

[FIG. 1]
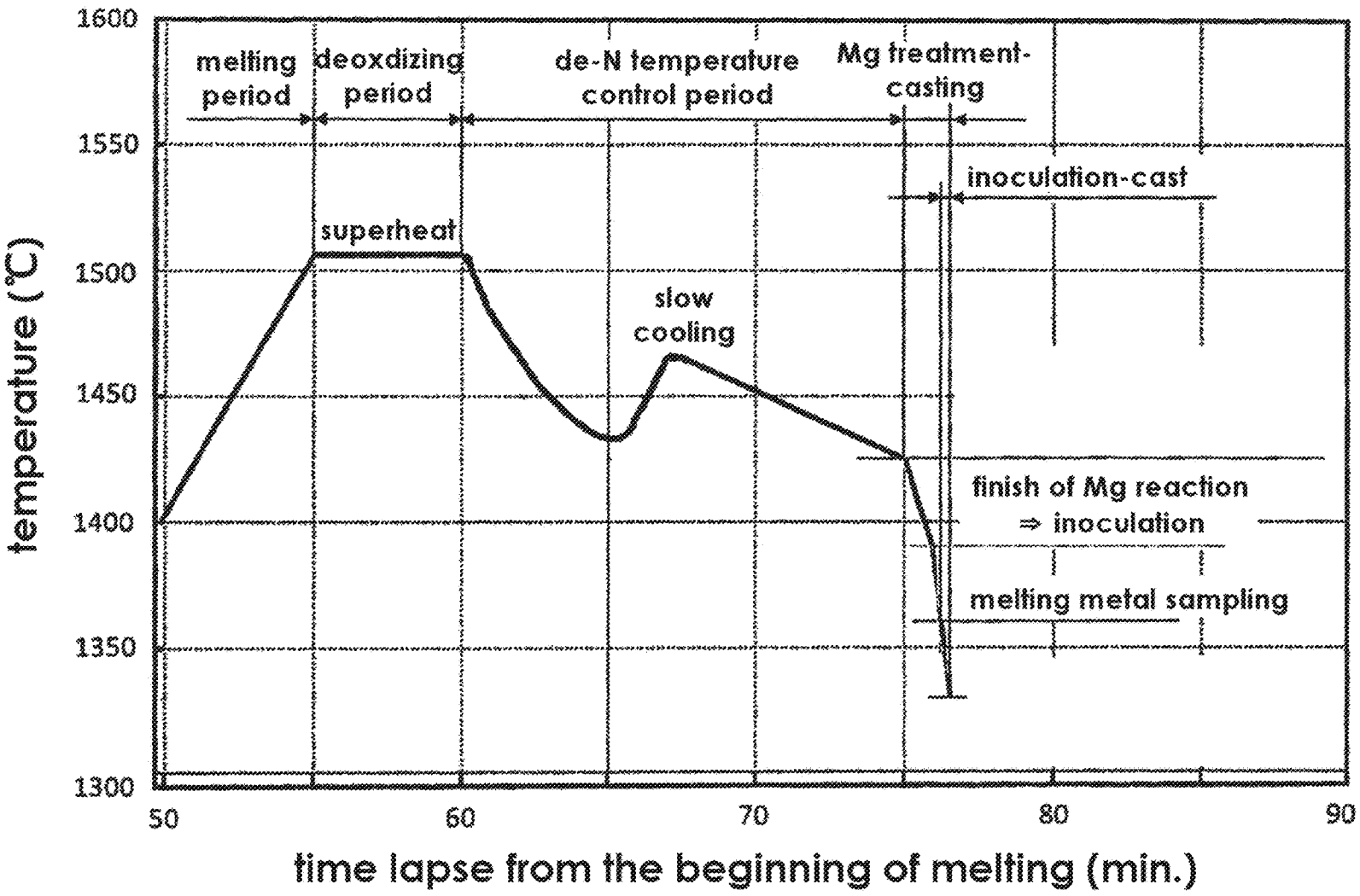

[FIG. 2]
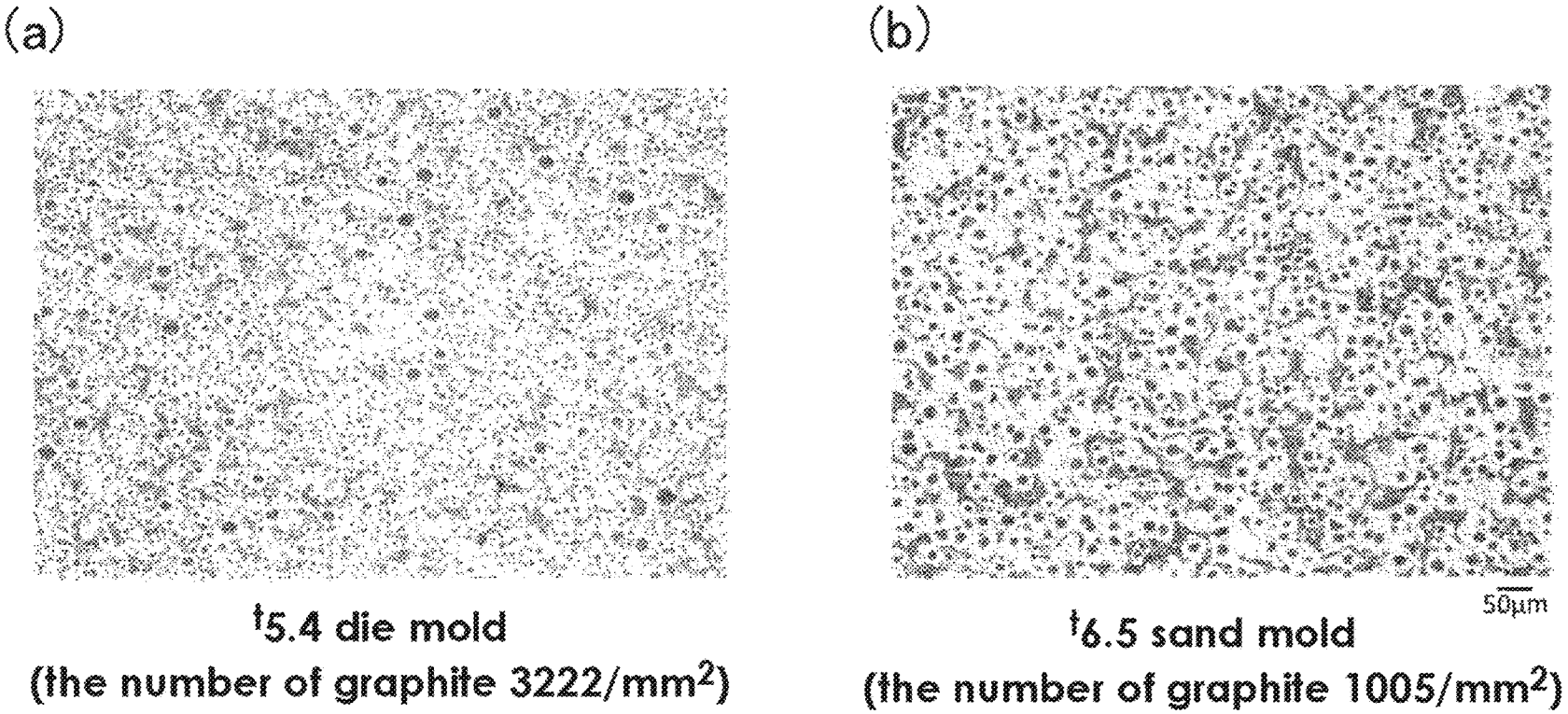

[FIG. 3]
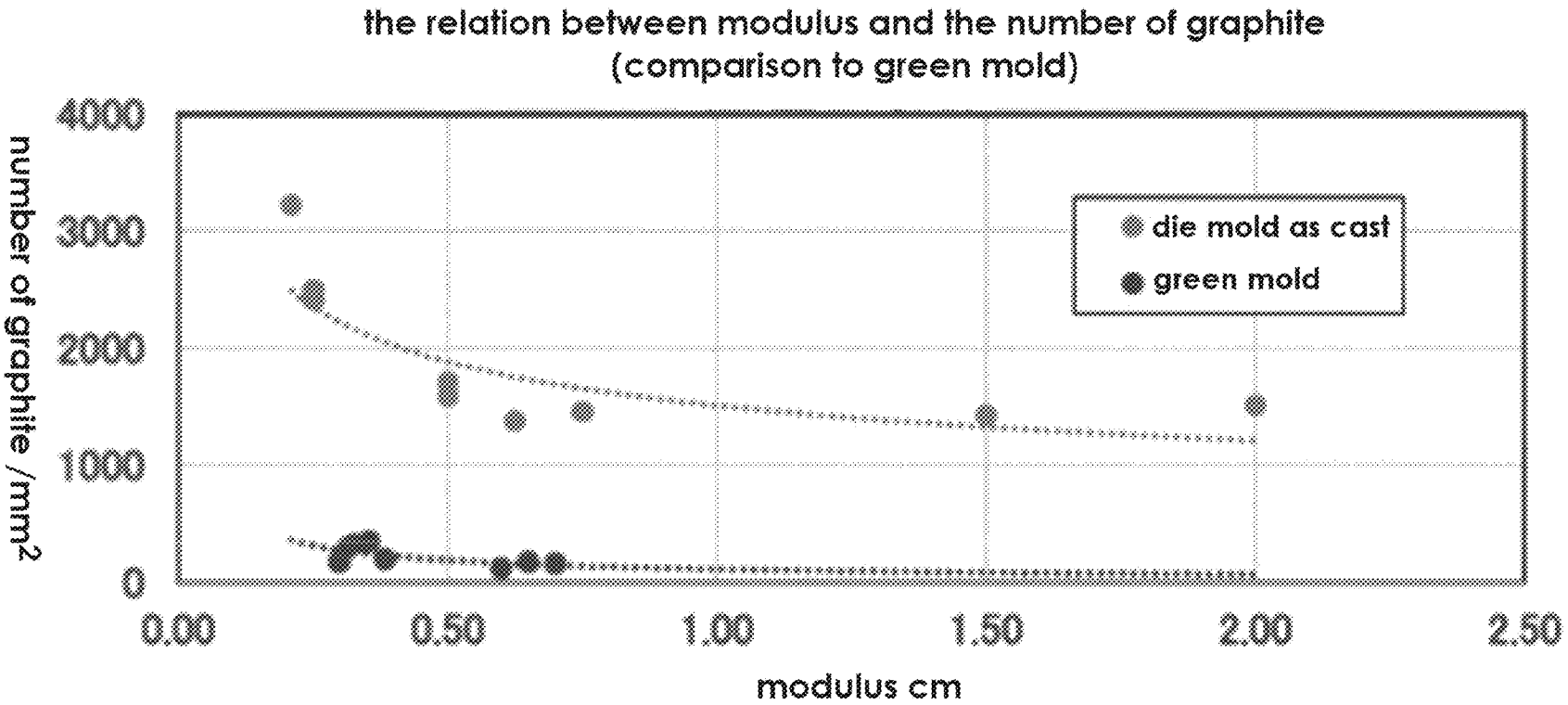

[FIG. 4]
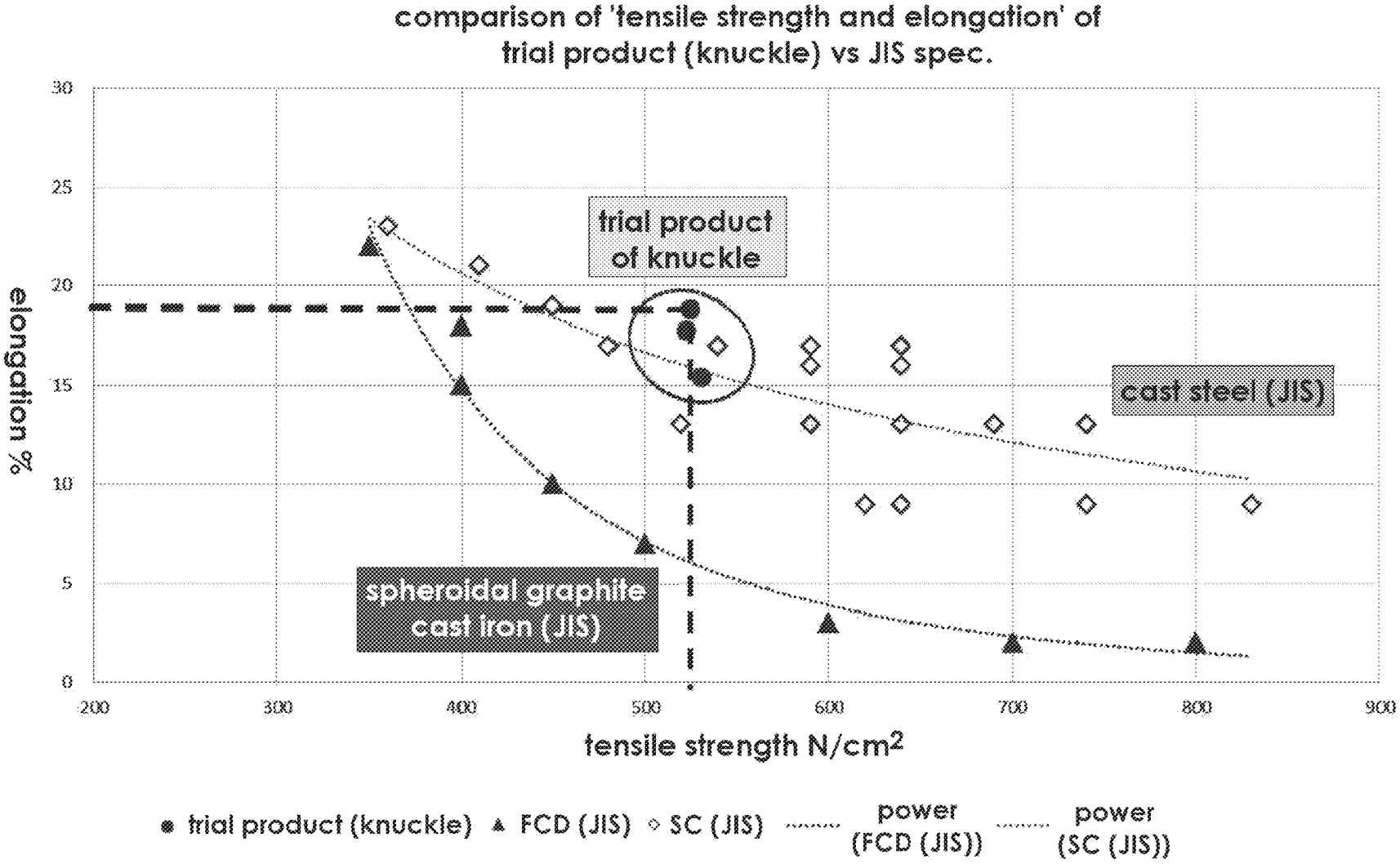

[FIG. 5]
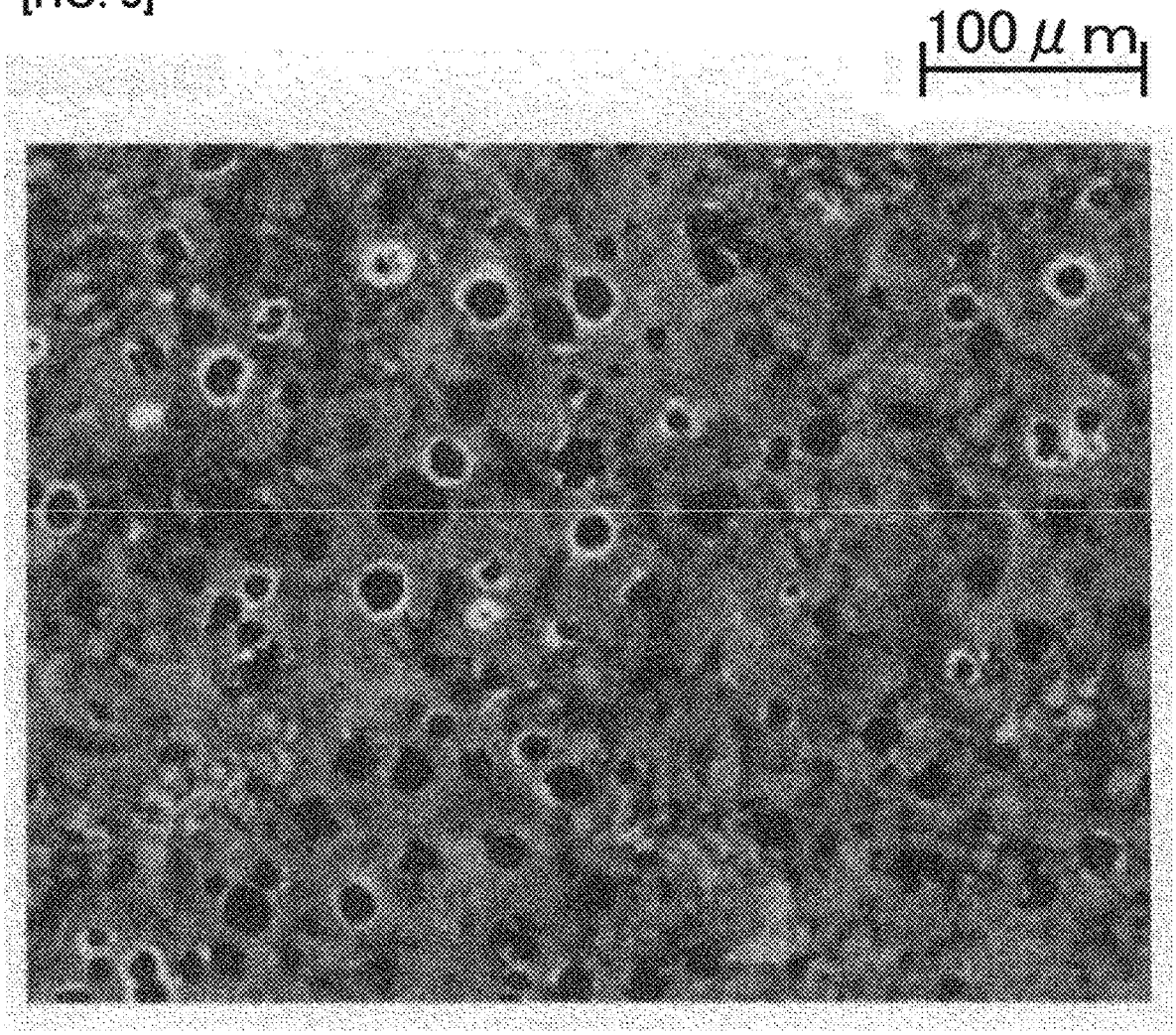

METHOD FOR PRODUCING DIE-CAST PRODUCT OF SPHEROIDAL GRAPHITE CAST IRON HAVING ULTRAFINE SPHEROIDAL GRAPHITE, AND DIE-CAST PRODUCT OF SPHEROIDAL GRAPHITE CAST IRON

The present invention relates to a method for producing a die casting of spheroidal graphite cast iron having ultrafine spheroidal graphite and a die casting of spheroidal graphite cast iron.

TECHNICAL FIELD

The present invention relates to a method of manufacturing a die casting of spheroidal graphite cast iron having ultrafine spherical graphite and a die casting of spheroidal graphite cast iron. More specifically, the present invention relates to a method of manufacturing a die casting of spheroidal graphite cast iron having no chill and a number of ultrafine spheroidal graphite more than the conventional case in the as cast state without heat treatment, and being expected improved tensile strength/elongation and other properties.

BACKGROUND ART

Spheroidal graphite cast iron is a kind of pig iron casting (alias, cast iron), also called ductile cast iron. Graphite of mouse cast iron has a thin strip shape with a strong elongated anisotropy. In contrast, graphite of spheroidal graphite cast iron has a spherical shape. Spherical graphite is achieved by adding a graphite spheroidizing agent containing magnesium, calcium and the like to the molten metal just before casting.

In spheroidal graphite cast iron, graphite without strength is spherical and independent. Therefore, this casting becomes a tough and strong casting to the same extent as steel. Spherical graphite means toughness, and spheroidized graphite is a cause of good properties of material strength and elongation. Currently it is widely used as a material for industrial machines including automobile industry.

The finer the graphite and the larger the number of the particles, the more the effect of suppressing the crack propagation at the time of impact is increased and the impact energy is increased. Efforts have been made to make the spheroidized graphite finer and uniformly dispersed for the purpose of further improving the material. A general metallographic structure of a conventional spheroidized graphite cast iron is shown in FIG. 3. As shown in FIG. 3, the conventional spheroidized graphite cast iron generally has 400 spheroidal graphite/mm$^2$. Attempts have also been made for spheroidal graphite cast iron as described in patent documents and non-patent documents described below.

In Japanese Patent Application Laid-Open No. 1-309939, the number of graphite particles is increased to 300 pieces/mm$^2$ or more by adding an appropriate amount of bismuth. In this technique, higher tensile strength and proof stress are achieved by adding an appropriate amount of nickel.

In Japanese Patent Application Laid-Open No. 6-93369, Ca is added to the molten metal in the presence of magnesium (Mg), and then Bi is added. This makes it possible to further improve machinability and mechanical properties by uniformly distributing spherical graphite finer than conventional spheroidal graphite cast iron and Ca compound in the steel as free-cutting element, thereby technology of free cutting spheroidal graphite cast iron is provided.

In Patent Document 3 (Japanese Patent Application Laid-Open No. 2003-286538), by controlling the amount of Bi added to ductile cast iron material, graphite is refined to improve mechanical properties. In this technique, the tensile strength is 450 MPa or more and the elongation is 20% or more by synergistic effect of Bi and Ca. Spherical graphite of at least 2,000 particles/mm$^2$ or more is measured, and the spheroidization ratio of 90% or more is maintained.

In Patent Document 4 (JP-A-2000-45011), a casting method of spheroidal graphite cast iron in which C: 3.10 to 3.90%, Si: 2.5 to 4.00%, Mn: 0.45% or less, P: 0.05% S: 0.008% or less, Cu: 0.5% or less, Mo: 0.3% or less, Mg: 0.05% or less, Bi+Sb+Ti: 0.1% or less are included, and a superfine graphite structure is contained by casting is disclosed. Thereby, a spheroidal graphite cast iron casting which has an ultrafine graphite structure having a graphite particle number of approximately 1900 particles/mm$^2$ and prevents occurrence of chill texture has been provided.

On the other hand, from the viewpoint of non-chilling, Non-Patent Document 1 ("Cast iron seen from the reaction theory") shows the relationship between the nitrogen content in the molten metal and the depth of chill, and nitrogen is classified as hydrochloric acid-soluble nitrogen and hydrochloric acid insoluble nitrogen, and shows the relationship with each chill depth (Non-Patent Document 1, pp. 116-123). However, there are cases where this classification does not necessarily apply, in Non-patent Document 2, attempts have been made to classify nitrogen as free nitrogen and other nitrogen, and to reduce the length of the chill by controlling the amount of free nitrogen. Here, the free nitrogen amount is the nitrogen amount obtained by subtracting the inclusion nitrogen amount which is inclusive from the total nitrogen amount. The amount of inclusion nitrogen is measured by JIS G 1228 (distillation-neutralization titrationmethod).

In Non-Patent Document 3, an as-cast product having no chill and having the number of spherical graphites of 850 to 1400 pieces/mm$^2$ is provided (first column on Table IX of Non-Patent Document 3).

PRIOR ART DOCUMENT

Patent Document

[Patent Document 1] Japanese Patent Application Laid-open No. 1-309939

[Patent Document 2] Japanese Patent Laid-Open No. 6-93369

[Patent Document 3] Japanese Patent Application Laid-Open No. 2003-286538

[Patent Document 4] Japanese Patent Application Laid-Open No. 2000-45011

Non-Patent Document

[Non-patent document 1] "Cast iron viewed from reaction theory" first edition Published by Nippon Cast Forging Association issued on Mar. 31 1992.

[Non-Patent Document 2] "Influence of Free Nitrogen Level on Graphite Solidification of Cast Iron" Summary of the 163 th National Convention Games (2013) 99.

[Non-Patent Document 3] REVISTA DE METALURGIA, 49 (5) SEPTEMBRE-OCTUBRE 325-339 2013 "Magnesium Mapofthe Spheroidalgraphite Structure in Ductile CastIrons (Ductile cast iron castings manufactured using metal molds)".

SUMMARY OF THE INVENTION

Problem to be Solved

In the conventional techniques described in the above-mentioned patent documents and non-patent documents, when die casting is carried out, chills exist in all documents. Heat treatment must be performed in order to eliminate chill.

In addition, the number of spheroidal graphite in the structure of the spheroidal graphite cast iron produced by using the above manufacturing method is small. Therefore, mechanical properties such as strength and elongation are not necessarily satisfied.

Also, in the technique of Patent Document 3, the occurrence of white powder which is thought to be oxide is recognized and lacks elongation characteristics. In Non-Patent Document 2, since chill length is influenced by the amount of free nitrogen, reduction of chill length is aimed at by removing free nitrogen. However, in Non-Patent Document 2, chill is generated despite containing chilled gold although it is not die casting. That is, if this technique is applied to a mold which is more prone to chill than the green mold, it suggests that chill with longer chill length will be generated. Moreover, the number and the particle size of the spherical graphite in the structure are not mentioned.

In the spheroidal graphite cast iron described in Patent Document 3, the number of spherical graphite is 2,000/mm$^2$ or more. However, this technology is not a technique of die casting. That is, there is no provision of die casting products with the number of spherical graphite of 2,000/mm$^2$ or more.

In Patent Document 4, Bi and are indispensable.

In non-patent document 3, only the brake caliper G (7.5 kg, wall thickness 43 mm) is the item without the chill on the surface and the center among the mold cast products, and the modulus M (cm) (M=V/S, V are volume, S is surface area) is more than 2.

According to the present invention, even in a small modulus, in the as cast state where heat treatment is not performed, there is no chill and the spherical graphite in the structure is ultrafineized, and the number thereof can be several times that of the conventional one A method of manufacturing a die casting of ultrafine spheroidal graphite cast iron, and a die casting product.

Means to Solve the Problem

The invention of claim 1 is a method of die cast product of ultrafine spheroidal graphite cast iron having steps;

a melting step of heating and melting raw materials made of cast iron to obtain source melting metal, a spheroidizing treatment step in which a spheroidizing treatment is performed, an inoculation step of inoculating, a casting step of casting in a die mold, characterized in that the amount of nitrogen is adjusted so that the amount of nitrogen generated in the time of melting becomes 0.9 ppm (mass) or less.

The invention of claim 2 is a method of die cast product of ultrafine spheroidal graphite cast iron according to claim 1, characterized in that obtaining source melting metal by heating and melting raw materials made of cast iron, heating the source melting metal to a predetermined temperature of 1500° C. or higher, stopping heating, and holding at that temperature for a certain period of time to remove oxygen from the source melting metal, then slowly cooling the source melting metal to reduce the nitrogen in the source melting metal, then spheroidizing, inoculating and casting.

The invention of claim 3 is a method of die cast product of ultrafine spheroidal graphite cast iron according to claim 1 or 2, wherein said spheroidizing treatment is carried out at an oxygen content of 20 ppm (mass) or less.

The invention of claim 4 is a method of die cast product of ultrafine spheroidal graphite cast iron according to any one of claims 1 to 3, wherein a heat insulating coating is provided on the mold surface.

The invention of claim 5 is a method of die cast product of ultrafine spheroidal graphite cast iron according to claim 4, wherein the heat insulating coating thickness is 0.4 mm or more.

The invention of claim 6 is a method of die cast product of ultrafine spheroidal graphite cast iron according to any one of claims 1 to 5, wherein the heat insulating coating having a thermal conductivity of 0.42 W/(m·K) or less is applied to the surface of the die mold.

The invention of claim 7 is a die cast product of ultrafine spheroidal graphite cast iron having a structure not containing chill and having the number of spherical graphites of 500/mm$^2$ or more in an as cast state. Provided, however, that die cast product containing Bi and cast iron having M greater than 2 are excluded.

The invention of claim 8 is a die cast product of ultrafine spheroidal graphite cast iron having a structure in which the number of spheroidal graphites in an as cast state is 1000 pieces/mm$^2$ or more. Provided, however, that die cast product containing Bi and cast iron with M exceeding 2 cm are excluded.

The invention of claim 9 is a die cast product of ultrafine spheroidal graphite cast iron having a structure in which the number of spheroidal graphites in an as cast state is 1,500 pieces/mm$^2$ or more. Provided, however, that die cast product containing Bi is excluded.

The invention of claim 10 is a die cast product of ultrafine spheroidal graphite cast iron, having a structure in which the number of spherical graphites is 2000 pieces/$^2$ or more in an as cast state.

The invention of claim 11 is a die cast product of ultrafine spheroidal graphite cast iron having a structure in which the number of spherical graphites is 3000 pieces/mm$^2$ or more in an as cast state.

The invention of claim 12 is a die cast product of ultrafine spheroidal graphite cast iron having a structure not containing chill in an as cast state.

The invention of claim 13 is a die cast product of ultrafine spheroidal graphite cast iron according to any one of claims 7 to 12, wherein M is 2.0 cm or less.

The invention of claim 14 is a die cast product of ultrafine spheroidal graphite cast iron according to any one of claims 8 to 12, wherein M is 0.25 cm or less.

The invention of claim 15 is a die cast product of ultrafine spheroidal graphite cast iron according to any one of claims 7 to 14, wherein the spherical graphite has a particle diameter of 4-8 μm which is larger than those of other particle diameters.

Even with a small modulus, in the as cast state where heat treatment is not performed, there is no chill, and the spherical graphite in the structure is ultrafineized, and the number can be several times as much as the conventional one.

Spheroidal graphite cast iron having both high elongation and high strength can be obtained.

BRIEF DESCRIPTION OF THE DRAWINGS

FIG. 1 is a graph showing steps of an embodiment of the present invention.

FIG. 2 is a structural diagram of a product manufactured according to an embodiment of the present invention.

FIG. 3 is a graph showing the number of graphite particles for a module of a product manufactured according to an example of the present invention.

FIG. 4 is a graph showing the mechanical properties of a product produced according to an example of the present invention.

FIG. 5 is a metallographic structure diagram of a conventional spheroidal graphitized cast iron.

DETAILED DESCRIPTION OF THE INVENTION

Hereinafter, an embodiment or carrying out the present invention will be described with reference to FIG. 1.

(Melting Step)

In the melting process, source material of spheroidal graphite cast iron is melted. As the source material, for example, raw materials specified in JIS G 5502 may be used. Other cast irons are also applicable. In addition, other elements may be added as necessary. Further, the composition range may be appropriately changed. Examples of JIS G 5502 include FCD 400-15, FCD 450-10, FCD 500-7, FCD 600-3, FCD 700-2, FCD 800-2, FCD 400-15, FCD 450-10, FCD 500-7 and the like.

In addition to the above-mentioned components, Bi, Ca, Ba, Cu, Ni, Cr, Mo, V, RE (rare earth element) may be appropriately added after melting. Further, CE (carbon equivalent) may be appropriately controlled, for example, to 3.9 to 4.6.

In the present invention, after melting, further heating is performed to raise the temperature of the original molten metal. By raising the temperature, oxygen is removed from the molten material.

Temperature rise is carried out until the temperature T 0 at which removal of oxygen from the original, molten material stops. Temperature rise is stopped when the temperature T 0 is reached, and the temperature is kept for a predetermined time at T 0. As keeping the temperature, generation of bubbles from the side wall of the crucible are observed, and keeping the temperature is stopped at that point. Normally, keeping the temperature is done between 2 and 10 minutes.

(Nitrogen Removing Step)

After removing the oxygen, nitrogen is removed.

In non-patent document 2, free nitrogen is controlled. However, since Non-Patent Document 2 is directed to a green mold, it cannot be applied to a die mold as it is, and an increase in the number of spheroidal graphite is not always recognized even if free nitrogen is controlled as described in Non-Patent Document 2.

In the case of die molds, it was found that by controlling nitrogen with reference to the amount of nitrogen generated at the time of melting, increase in the number of spheroidal graphite can be controlled.

The amount of nitrogen generated in the time of melting is the amount of nitrogen gas at the time of melting when the cast product is melted. It is nitrogen generated when cast iron changes from a solid to a liquid. It can be known by the examining the final casting products.

Specifically measure performed by the following procedure. To remove the oxide film, the oxide film was removed by FUJI STAR 500 (Sankyo Rikagaku) sandpaper until the surface metallic luster disappeared, then cut with a micro-cutter or reinforcing bar cutter to obtain 0.5-1.0 g of a sample. The sample cut by shearing is washed by acetone for oil removal, and dried for a few seconds with a dryer or by vacuum dry and then analyzed For analysis, turn on power to the device, send He gas, perform system check and leak check, arid confirm that there is no abnormality. After stabilization, start analysis. When analyzing, zero-point correction is performed by discarding analysis and blank measurement.

For the blank analysis, first the crucible is set, and about 0.4 g of a combustion improver (graphite powder) is added. The combustion improver is added for the purpose of improving the nitrogen extraction rate in the alloy. While introducing He, purge the out gas and replace the inside of the sample chamber with He gas. Subsequently, in order to remove oxygen and nitrogen generated from the graphite crucible by preliminary heating, the gas generated from the crucible is removed by heating at a temperature equal to or higher than the analysis temperature (for example, 2163° C.) for 15 seconds. Thereafter, analysis is performed under elevated temperature conditions, and numerical values obtained are blank and corrected so as to be a zero point base.

As a calibration curve preparation standard sample a calibration curve is prepared based on the values obtained by three times measurement of each sample by using LECO 114-001-5 (nitrogen 8±2 ppm, oxygen 115±19 ppm), 502 to 873 (47±5 ppm oxygen 34±5 ppm nitrogen), 502 to 869 (nitrogen 414±8 ppm oxygen 36±4 ppm), 502-416 (nitrogen 782±14 ppm oxygen 33±3 ppm).

In the temperature elevation analysis, it gradually dissolves from the low melting point substance, and nitrogen contained in the melted substance is extracted for each temperature, and a waveform peak is obtained.

Calculate the amount of nitrogen per unit area from the total area of waveform peaks (sum of peak intensity values) and the amount of nitrogen obtained by analysis, and quantify the nitrogen generated at the early temperature rising around 1250-1350° C. Also in the above analysis, if attention is paid to the portion of nitrogen generated when the cast iron changes from a solid to a liquid, the amount of nitrogen generated during melting can also be determined.

With respect to nitrogen, it can be removed from the original molten metal by decreasing the solubility in the original molten metal. To that end, the molten metal is slowly cooled. With rapid cooling, nitrogen may not be drawn out from the original molten metal in some cases. The cooling rate is preferably 5° C./min or less. Cooling is preferably carried out up to T (° C.) in the equation 1. When cooling is performed to a temperature lower than T (° C.), oxygen uptake starts on the contrary. It is preferable to cool down to T<° C.> in order to minimize both nitrogen and oxygen.

Considering practical viewpoints, it is preferable to cool down to (T−15° C.)±20 (° C.).

$$T = Tk - 273(^\circ\ C.) \qquad \text{Equation (1)}$$

$$\text{Log}\ ([Si]/[C]2) = -27{,}486/Tk + 15.47$$

In the cooling process, nitrogen is released from the original water. That is, since the saturated solubility of nitrogen in the base molten metal is reduced by slow cooling, nitrogen not forming a compound with other elements is released from the base water. For example, bubbling of argon gas may be performed. By this cooling, nitrogen escapes from the former original molten metal.

(Spheroidizing Treatment Step)

At the point of cooling to T (° C.) in Equation 1, spheroidization treatment is performed. Here, the spheroidizing treatment is generally performed by addition of Mg. Other methods (for example, spheroidizing treatment with a treating agent containing Ce) may be used.

However, compared to Ce, in the case of Mg, the extent of refinement and the number of spheroidal carbon per unit are overwhelmingly superior. The Mg-containing treatment agent is preferably Fe—Si—Mg. In particular, it is preferable to use a treating agent having Fe: Si: Mg=50:50: (1 to 10) (mass ratio). When the Mg ratio is less than 1, sufficient spheroidization can not be performed. On the other hand, if it exceeds 10, bubbling will occur and gas entrapment will occur. From this viewpoint, 1 to 10 is preferable, and 1 to 5 is more preferable. It is preferable to perform the spheroidizing treatment at an oxygen content of 20 ppm (mass) or less. When the content is 20 ppm or less, finely spheroidized graphite can be obtained.

(Inoculation step)

Inoculate immediately after spheroidization treatment. Inoculation is carried out by adding, for example, Fe—Si to the molten metal. For example, Fe—75 Si (mass ratio) is suitably used.

(Casting process)

Pour casting is performed after adding inoculant Fe—Si. It is preferable to perform casting in a state in which the inoculant is not diffused and stirred. It is preferable to shorten the time to, for example, 10 minutes or less, 5 minutes or less, 1 minute or less, 5 seconds or less in consideration of equipment factors and the like.

The casting is preferably carried out at Tp±20 (° C.).

Here, $Tp=1350-60M$(° C.)“

$M=V/S$

V is product volume ($cm^3$), S is product surface area ($cm^2$)

The mold temperature is preferably Td±20 (° C.).

$Td=470\text{-}520M$(° C.)

$M=V/S$

V is product volume ($cm^3$), S is product surface area ($cm^2$)

It is preferable to control the mold temperature according to the volume of the product. Spheroidized graphite can be formed more finely and uniformly by controlling the mold temperature.

However, depending on the conditions, there exists a risk of misrunnig of metal, so it is preferable to set the minimum temperature of the mold to 100° C.

(Inoculation)

The inoculation treatment is preferably carried out by adding Fe—Si.

It is preferable to carry out as soon as possible after adding Fe—Si. The shorter the time after inoculation, the finer the spheroidized graphite per unit area is. As the time is short, the diffusion of Fe—Si into the melt becomes slower, and the density of the spheroidized graphite increases accordingly.

Depending on the apparatus and the like, for example, the casting is preferably carried out within 10 minutes, more preferably within 5 minutes, more preferably within 30 seconds, and within 5 seconds, the better. When is cast is carried out in a state before dissolution and after diffusion of Fe—Si, the number of spheroidized graphite is dramatically increased as compared with the case where it is uniformly dissolved. In order to further promote such a state, it is preferable to perform casting without stirring.

It is preferable to apply a heat insulating coating to the metal mold. In particular, a heat-insulating coating mold is preferable, and a thermal conductivity of 0.42 w/(m·K) or less is particularly preferable. Specifically, it is preferable to apply a heat insulating coating to a thickness of 0.4 mm or more.

Example 1

A raw material having the following composition was used (mass %).

C: 3.66, Si: 2.58, Mn: 0.09, P: 0.022, S: 0.006, the balance of Fe

The T of the formula (1) in the composition of this raw material is obtained as follows.

$Tk=1698(K)$ $T=Tk-273=1425$(° C.)

This raw material was melted by heating in a furnace. Heating was continued even after melting, passed through 1425 (° C.), and the temperature raising was continued. Oxygen is removed at temperatures above 1425 (° C.).

As the temperature was further raised, generation of oxygen from the heat resistant material of the furnace was observed at a temperature exceeding 1510° C. Therefore, the temperature rise was stopped at 1510° C. and kept at 1510° C. for 5 minutes (referred to as superheat here). During this period, oxygen is removed from the original molten metal.

After maintaining at 1510° C. for 5 minutes, it was gradually cooled to 1425° C. T C.) at an average rate of about 5° C./min. The temperature was once lowered to 1440° C., then increased to 1460° C. and then cooled at a rate of 5 min/min. That is, instead of gradually cooling down to T ° C. after superheat, it was once cooled faster than a straight line and then cooled linearly after raising the temperature. By performing such gradual cooling, entrainment of atmospheric constituents into the molten metal could be greatly reduced as compared with linearly gradual cooling. It is thought that additional heating is necessary when trying to cool linearly, and entrainment of the atmosphere occurs by stirring at the time of heating. After superheat, it is preferable to perform natural cooling so that entrainment of the atmosphere does not occur up to 1460° C. As a result, contamination of nitrogen from the outside can be reduced, and the amount of nitrogen and eventually the amount of nitrogen generated in the time of melting can be controlled more accurately and can be reduced.

As the melt temperature decreases, the solubility of nitrogen in the molten metal decreases, so nitrogen is produced. The amount of saturation of nitrogen into the molten metal decreased by slow cooling, and unsaturated nitrogen was released from the melt. When cooling to the temperature of T, a part was taken out from the molten metal and the content of oxygen was analyzed, it was 20 ppm or less.

Next, Mg treatment was performed. The Mg treatment was carried out by adding Fe—Si-3 Mg. Inoculation was carried out after Mg treatment. Inoculation was carried out by using an inoculant of 0.6 mass % Fe–75 Si and supplying through the surface of the molten metal with stirring. The product is a coin with a diameter of 1 cm and a thickness (t) of 5.3 mm. The casting temperature and the mold temperature were set as follows.

Also, 0.4 mm of heat insulating coating was applied to the die mold. The thermal conductivity of the coating mold was 0.42 w/(m·K).

The casting temperature Tp is, $$M=V/S=0.34$$

$$Tp=1350-60M=1320^\circ\ C.$$

The die mold temperature Td is, $$Td=470\text{-}520M=293.2(C)$$

Casting was performed in the mold 10 seconds after the completion of the inoculation under the casting temperature and the mold temperature set as above. After casting, the following results were obtained.

The composition of the product was as follows (mass %).

C: 3.61, Si: 3.11, Mn: 0.10, P: 0.024, S: 0.008, Mg: 0.018.

The structure of the sample after casting was observed with a micrograph. The organization chart is shown in FIGS. 2(*a*) and 2(*b*) is a reference example of a sand molded product.

The spherical graphite was very fine and uniformly distributed. When the number of spheroidized graphite was counted, the number was 3222/mm$^2$.

Example 2

In the present example, the amount of nitrogen generated in the time of melting was varied, and the relationship between the amount of nitrogen generated in the time of melting and the occurrence of chill was examined.

The experiment was conducted in the same manner as in Example 1. In each case, a 0.4 mm thick heat insulating coating was formed on the mold surface. The results are shown below.

The amount of nitrogen in the time of melting T T casting temperature Presence or absence of chill (Ppm) (° C.)

1.05 1415 1303 Yes 1.15 1439 1436 yes 0.89 1430 1316 None 0.93 1429 1390 yes 0.22 1432 1310 None 0.63 1432 1315 None 0.37 1430 1312 nothing As shown in the above result, the amount of nitrogen generated in the time of melting was 0.9 ppm as a critical value, and when controlled to less than that, no chill was generated.

When there was no generation of chill, the number of spheroidal graphite was much larger than when chill is generated.

Comparative Example

In this example, after melting the raw material, the temperature was raised to 1510° C. and then cast into a metal mold. However, sand mold was used in this example.

The other points were the same as in Example 1.

The result is shown in FIG. 2(*b*).

In the present example, 1005 pieces/mm$^2$ was seen.

Example 3

In this example, we conducted experiments with different coating types.

Experiments were conducted on the following three types of coatings. The other conditions are the same as those in the first embodiment.

A Heat-insulating coating (thickness 0.4 mm) Thermal conductivity: 0.42 W (m·K)

B Heat-insulating coating (thickness 0.7 mm) Thermal conductivity: 0.2 W/(·K)

C Heat-insulating coating (thickness: 0.2 mm) Thermal conductivity: 0.85 W/(m·K)

D carbon black thermal conductivity: 5.8 W/(m·K)

A is the same as in Example 1.

In the case of the heat insulating coating type (A-C), no chill was observed. However, when the thickness was 0.2 mm, the number of the spherical graphite was smaller than that in the case of 0.4 mm and the particle size was large. In the case of 0.7 mm, it was almost the same as 0.4 mm.

Also, in the case of carbon black, no chill was observed, but the number of spheroidal graphite was further smaller than in the case of 0.2 mm thick heat insulating coating.

Example 4

In this example, the metal mold temperature was varied in the range of 25° C. to 300° C.

The test was carried out at 5 points of 25° C., 178° C., 223° C., 286° C. and 300° C. Incidentally, a heat-insulating coating was applied with 0.4 mm thickness.

The other points were the same as in Example 1.

Chill formation was observed in the case of 25° C. No occurrence of chill was observed for other temperatures. The particle diameter was the smallest in the case of 286° C.

Example 5

In this example, a die casting product was produced by varying the modulus (M) within the range of 0.25 to 2.0 (cm).

The manufacturing conditions are the same as in Example 1.

The number of spheroidal graphite was measured for each die casting manufactured.

The results are shown in FIG. 3 together with the case of the raw mold type.

No occurrence of chill was observed for any of the products.

As shown in FIG. 3, although the modulus (M) is small, the structure has more than 1500 particles/mm$^2$ of micro spheroidal graphite.

Example 6

In this example, trial product of knuckles were produced and the mechanical properties thereof were evaluated.

In this example, a filter was installed in the sprue to remove foreign matter as much as possible. However, slight foreign matter remained.

The test results are shown in FIG. 4 together with conventional examples.

As a result of evaluating the mechanical properties of the trial product of knuckle, it was the result showing the mechanical properties of the cast steel product although the material is spheroidal graphite cast iron. For example, one tensile strength 525 N/cm$^2$ product of knuckle prototype has elongation of 18.8%, and in general spheroidal graphite cast iron, since the tensile strength is around 380 N/cm$^2$ in comparison with equivalent elongation. The tensile strength was 5 times higher, and mechanical properties comparable to cast steel were obtained.

INDUSTRIAL APPLICABILITY

The present invention can also be applied to automobile parts such as knuckles and the like which are required to have high toughness and strength, and electric and electronic parts.

The invention claimed is:

1. A method of die cast production of spheroidal graphite iron castings, the method comprising:

obtaining base molten iron by heating and melting raw materials, heating the base molten iron to a first predetermined temperature above 1500° C., stopping heating, and holding the base molten iron at the first predetermined temperature for 2 to 10 minutes to remove oxygen from the base molten iron, then, cooling down the base molten iron at an average cooling rate of 5° C./min or less to a second predetermined temperature of (T−15° C.)±20 (° C.) to reduce a nitrogen in the base molten iron, and wherein, T=Tk−273 (° C.), Log ([Si]/[C] 2)=−27486/Tk+15.47, where [Si], [C]: mass % in the base molten iron, wherein the nitrogen is naturally reduced by a difference of solubility between the first and second predetermined temperatures, and then, at the second predetermined temperature, conducting a spheroidization treatment with an alloy agent, and then after the spheroidization treatment, conducting an inoculation and a casting to thereby adjust the amount of nitrogen so that the amount of nitrogen generated in the time of melting becomes 0.9 ppm (mass) or less.

2. The method of die cast production of spheroidal graphite iron castings according to claim 1, wherein said spheroidization treatment is carried out at a total oxygen content of 20 ppm (by mass) or less.

3. The method of die cast production of spheroidal graphite iron castings according to claim 1, wherein a mold surface is coated with a heat insulating material to form a heat insulating coating.

4. The method of die cast production of spheroidal graphite iron castings according to claim 3, wherein a thickness of the heat insulating coating thickness is 0.4 mm or more.

5. The method of die cast production of spheroidal graphite iron castings according to claim 3, wherein the heat insulating material applied as the coating has a thermal conductivity of 0.42 W/mK or less.

6. The method of die cast production of spheroidal graphite iron castings according to claim 1, further comprising:

after the step of holding the base molten iron at the first predetermined temperature, by natural cooling, cooling down the base molten iron to close to the second predetermined temperature, then, raising the temperature of the base molten iron again, and then, after raising the temperature of the base molten iron, further cooling the base molten iron linearly back down to the second predetermined temperature for conducting the spheroidization treatment.

7. The method of die cast production of spheroidal graphite iron castings according to claim 6, wherein during the further cooling of the base molten iron linearly back down to the second predetermined temperature, the cooling rate is 5° C./min or less.

8. The method of die cast production of spheroidal graphite iron castings according to claim 1, wherein the die temperature is Td±20 (° C.), and Td=470-520 M(° C.), M=V/S, where M is modulus (cm), V is volume (cm$^3$) of each of the spheroidal graphite iron castings, S is surface area (cm$^2$) of each of the spheroidal graphite iron castings.

9. The method of die cast production of spheroidal graphite iron castings according to claim 1, wherein the spheroidal graphite iron castings contain over 3000/mm$^2$ in an as-cast condition with no chill formation.

10. The method of die cast production of spheroidal graphite iron castings according to claim 1, further comprising:

after the step of holding the base molten iron at the first predetermined temperature, cooling down the base molten iron, at a rate faster than a straight line, to close to the second predetermined temperature then, raising the temperature of the base molten iron again, and then, after raising the temperature of the base molten iron, further cooling the base molten iron linearly back down to the second predetermined temperature for conducting the spheroidization treatment.

* * * * *